US005124614A

United States Patent [19]

Bakker et al.

[11] Patent Number: 5,124,614

[45] Date of Patent: Jun. 23, 1992

[54] DISPLAY TUBE HAVING DISCRETE X-RAY ABSORBING MEANS AND METHODS OF MANUFACTURE

[75] Inventors: Gijsbertus Bakker; Wouter M. Reukers, both of Eindhoven, Netherlands

[73] Assignee: U.S. Philips Corporation, New York, N.Y.

[21] Appl. No.: 606,017

[22] Filed: Oct. 30, 1990

[30] Foreign Application Priority Data

Oct. 30, 1989 [NL] Netherlands ..... 8902674

[51] Int. Cl.[5] ..... H01J 9/42; H01J 29/06

[52] U.S. Cl. ..... 313/479; 315/85; 445/3; 445/58

[58] Field of Search ..... 313/479; 358/245; 250/515.1; 315/85; 445/3, 58

[56] References Cited

U.S. PATENT DOCUMENTS 3,562,518 2/1971 Javorik et al. ..... 313/479 X 4,916,358 4/1990 Bunton ..... 313/479

*Primary Examiner*—Sandra L. O'Shea

*Attorney, Agent, or Firm*—Paul R. Miller

[57] ABSTRACT

A method of manufacturing a display tube comprising an envelope having an envelope portion and a display window. The quantity of X-rays released from the envelope portion is determined, after which discrete X-ray absorbing means are provided in those places of the envelope where the quantity of X-rays released exceeds a limiting value. In a display tube manufactured according to such a method and comprising, in particular, a substantially rectangular display screen and a cylindrical neck portion having an electron gun the diagonals of the envelope of which are provided with discrete X-ray absorbing means, the desirable quantity of X-rays is absorbed in a simple and cost-effective manner.

19 Claims, 4 Drawing Sheets

DISPLAY TUBE HAVING DISCRETE X-RAY ABSORBING MEANS AND METHODS OF MANUFACTURE

BACKGROUND OF THE INVENTION

The invention relates to a method of manufacturing a display tube comprising an envelope having a display window, and means of absorbing X-rays, provided on the envelope during a process step.

The invention also relates to a display tube manufactured according to such a method.

A display tube can be used in black-and-white, colour and projection television, apparatus for displaying digits and letters (Data Graphic Display) and in other apparatus.

In conventional display tubes an image is produced by generating an electron beam and deflecting the beam across a luminescing display screen provided on the inside of the display window. When an image is displayed, X-rays are sometimes generated in the display tube. Safety requirements determine the permissible X-ray release, which will hereinafter be termed the limiting value. U.S. Pat. No. 3,562,518 discloses a method of absorbing X-rays released from a display tube by surrounding the neck portion of the envelope with a coating impregnated with bismuth, and surrounding the remaining portion of the envelope almost completely with a coating containing bismuth trioxide. The absorption must be such that the quantity of X-ray release remains below the limiting value.

The display tubes which are developed and manufactured at present increasingly exhibit X-rays produced in operation. Moreover, safety requirements are becoming tighter in general, and are different from country to country. If the tighter safety requirements are to be met, the absorption of X-rays must be increased.

In the case of the display tube described in U.S. Pat. No. 3,562,518, the tighter safety requirements can be met by increasing the quantity of bismuth and bismuth trioxide. However, this leads to an increased cost and to a higher weight of the display tube.

OBJECTS AND SUMMARY OF THE INVENTION

One of the objects of the invention is to provide a method of manufacturing a display tube, in which the desired quantity of X-rays can be absorbed by using a minimum of X-ray absorbing means.

For this purpose, a method of the type described in the opening paragraph is characterized according to the invention in that the quantity of X-rays released from the envelope is determined before the means are provided, after which discrete X-ray absorbing means are provided at least in those places of the envelope where the X-ray release exceeds a limiting value. Discrete means are to be understood to mean herein means of absorbing X-rays, which are locally provided on a portion of the envelope. Limiting value is to be understood to mean herein the permissible quantity of X-rays released. The limiting value is determined mainly by safety requirments which may differ from country to country. The discrete X-ray absorbing means may be formed by, for example, one or more localised layers containing a heavy metal. Preferably, a heavy metal-containing tape, e.g., impregnated with a heavy metal, is used which can be easily adhered to the envelope portion in the desired places. If the tape is self-adhesive, a separate adhesive can be omitted.

The invention is based on the insight that the quantity of X-rays released from the display tube during the display of an image is not uniformly distributed over the envelope portion. This non-uniform distribution of X-rays may have various causes. For example, the envelope may be manufactured with a non-uniform wall thickness, so that the X-rays are not uniformly absorbed, or it is alternatively possible that components within the envelope on which the electron beams impinge emit X-rays in a non-uniform manner. According to the invention, the possibility of adapting the number of means or the quantity of X-ray absorption of every single means to the safety requirements and the limiting value is obtained by providing the envelope portion with discrete X-ray absorbing means in places where the X-ray release exceeds the limiting value. The discrete X-ray absorbing means, for example, only have to be provided on those parts of the envelope where they are required to obtain a desired X-ray absorption. In this manner, a saving in X-ray absorbing means is obtained, so that a display tube manufactured by using the inventive method is more economical than the known display tubes in which the envelope is provided with a uniform quantity of X-ray absorbing means, including those places where a smaller quantity would be sufficient.

The invention also relates to a display tube manufactured by the method according to the invention, and to a display tube comprising an envelope having an envelope portion and a display window characterized in that the envelope portion is locally provided with discreet X-ray absorbing means, so that the X-ray release during operation of the display tube remains below a limiting value. In an alternative embodiment, the envelope portion may be provided with, for example, a uniformly provided layer containing a heavy metal and, where necessary, discrete means.

With certain types of display tubes, the distribution of the X-rays released and, consequently, the places on the walls of the envelope where X-ray absorption is desirable can be determined by measuring the radiation of each individual display tube or of a test tube during operation. When it is not necessary to measure the tube itself during operation, the discrete X-ray absorbing means can be advantageously provided on the inside of the envelope portion, so that more space is available on the outside of the envelope for providing other components.

A further preferred embodiment of a display tube according to the invention, is characterized in that the discrete X-ray absorbing means comprise a heavy metal-containing tape, for example in impregnated form. A tape, in particular a self-adhesive tape, can be rapidly and simply provided on the envelope.

A further preferred embodiment of a display tube according to the invention, in which the display window is provided on the inside with a substantially rectangular luminescing display screen, and the envelope portion is provided with a cylindrical neck portion, is characterized in that at least the diagonals of the envelope portion are locally provided with discrete X-ray absorbing means. By the diagonals are meant the parts of the envelope portion where the planes passing through diagonals of the display screen and through the axis of the display tube, intersect the envelope portion.

In practice it has been found that in such a display tube the X-rays are released mainly at the location of the diagonals of the envelope portion. This can be attributed to the fact that the envelope portion is manufactured so that it is thinner at the location of the diagonals than in other places. Consequently, in such a display tube a desired X-ray absorption can be attained in a cost-effective manner without previously measuring the quantity of X-rays released.

A further preferred embodiment of a display tube according to the invention is characterized in that the envelope portion is further provided with a heavy metal-containing layer which substantially covers the entire envelope portion. If the glass wall of the envelope portion insufficiently absorbs the X-rays, it is to be preferred to first provide a layer containing a heavy metal on the envelope portion so as to substantially cover it. In this manner, the quantity of X-rays released can be kept below the limiting value over a large part of the envelope portion. Localised parts of the envelope portion where the X-ray release is still too high are then provided with discrete means.

These and other aspects of the invention will be described and explained by means of examples and with reference to the accompanying drawing.

DESCRIPTION OF THE PREFERRED EMBODIMENTS

Figure 1:
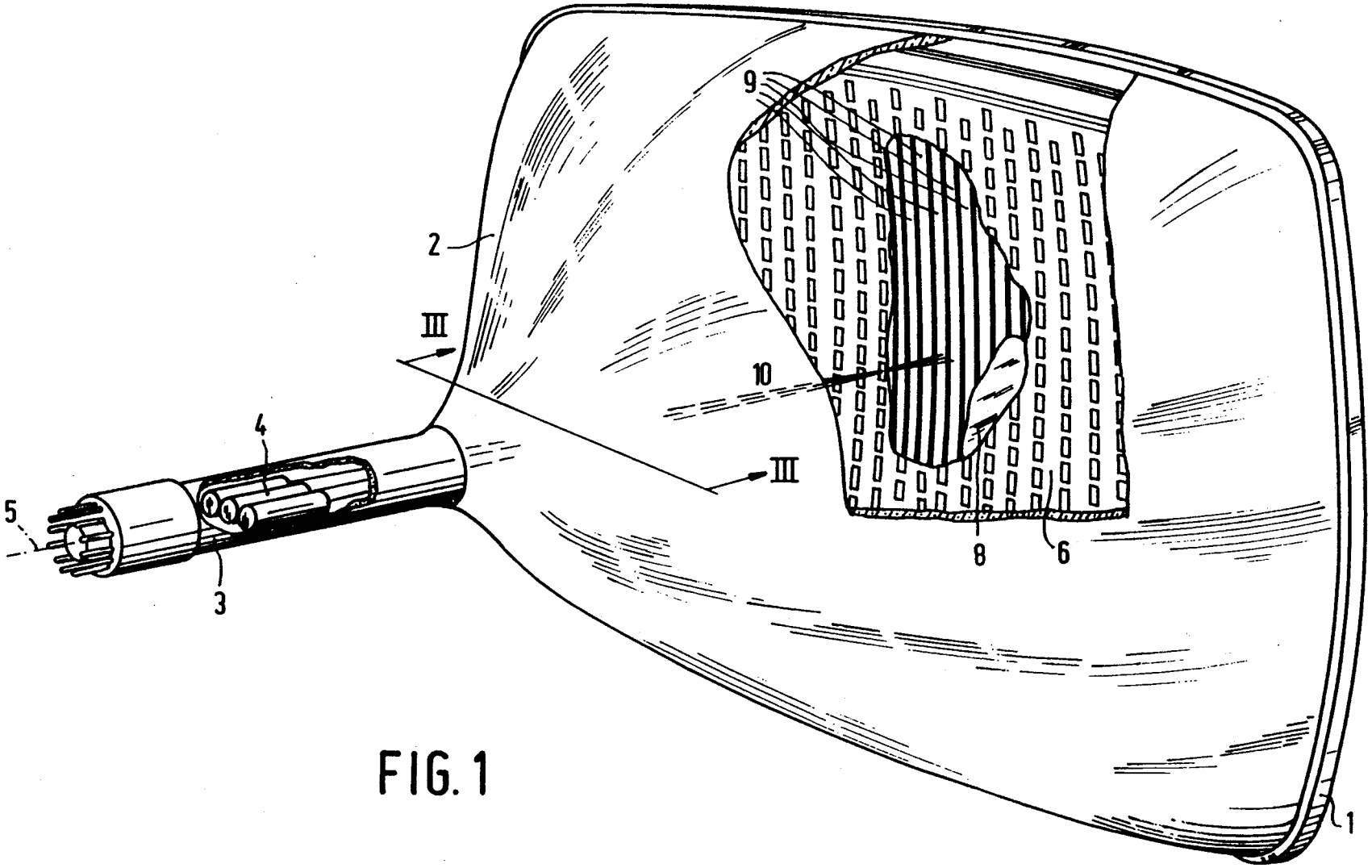
FIG. 1 is a diagrammatic, perspective, partly cutaway elevational view of a display tube.

FIG. 1 is an elevational view of a display tube comprising a glass envelope having a display window 1 secured to a conical enveloping portion 2 having a cylindrical neck portion 3. In this neck portion 3 there is provided an electron-generating system 4 for generating an electron beam 10 which is focused on a luminescing display screen 8 provided on the inside of the display window 1. The display screen 8, comprises, for example, a large number of phosphor elements 9 luminescing in red, green and blue with the phosphor elements being strip-shaped in this case. On its way to the display screen 8 the electron beam 10 is deflected across the display screen 8, by means of a number of deflection coils (not shown) which are coaxially arranged about the tube axis 5. When an image is displayed, X-rays are generated in the display tube, for example, because the electrons in the electron beam 10 impinge on the display screen 8 or, in the case of a colour display tube, are incident on the colour selection system 6. To reduce the quantity of X-rays released to a permissible level, the envelope portion is provided with X-ray absorbing means (not shown in FIG. 1) in a process step in the manufacture of the display tube.

According to one aspect of the invention, discrete X-ray absorbing means are provided after the quantity of X-rays released from the envelope portion during operation of the display tube is determined, for example, by measuring the quantity of X-rays by means of X-ray detecting equipment. In practice it has been found, that the quantity of X-rays released is not uniformly distributed over the envelope portion. Certain parts of the envelope portion release more X-rays than others. The quantity of X-ray absorbing means can be minimised, while maintaining the desired X-ray absorption by providing, in accordance with the invention, discrete X-ray absorbing means in those parts of the envelope portion where the quantity of X-rays released exceeds a limiting value. Thus, according to the invention, a permissible X-ray release, below the limiting value dictated by safety requirements, can be attained by attuning the quantity of X-ray absorbing means to the quantity of X-rays released.

Figure 2:
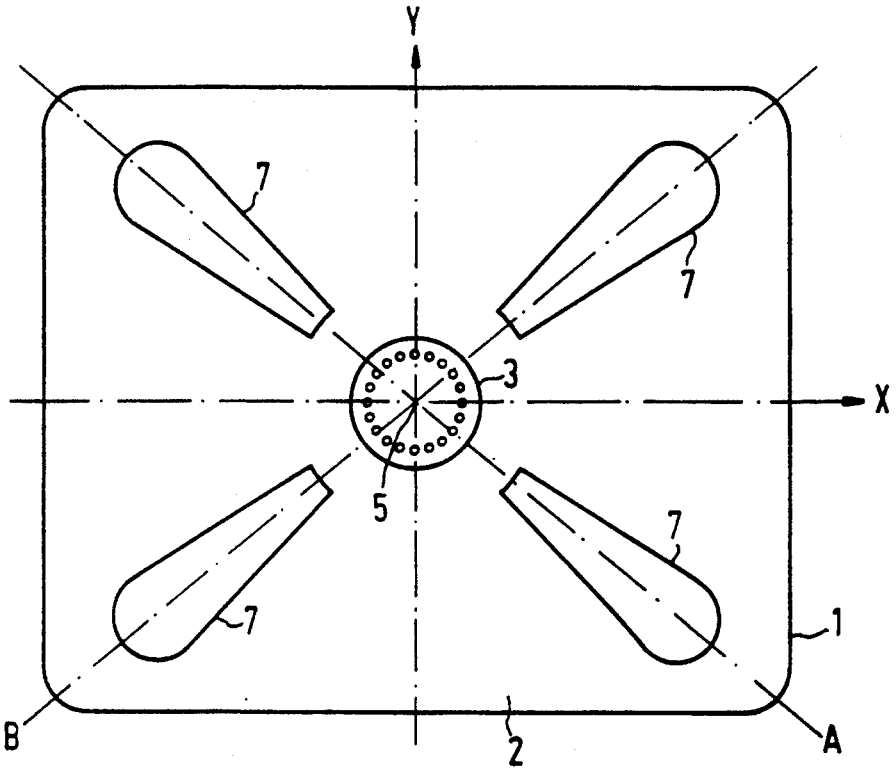
FIGS. 2 and 2*a* are diagrammatic rear view of an embodiment of a display tube according to the invention.

FIG. 2 is a diagrammatic elevational view of an embodiment of a display tube according to the invention, viewed from the rear in the direction of the tube axis 5. The display window 1 and the display screen (not shown) are substantially rectangular, permitting the diagonals A and B to be defined. For clarity, the deflection coils are not shown. In such a display tube, the shape of the sections transverse to the tube axis 5 vary along the tube axis 5. The section of the envelope portion 2 near the neck portion 3 exhibits a substantially circular shape, and the section near the end of the envelope portion 2 to which the display window 1 is secured exhibits a substantially rectangular shape. This shape of the envelope portion 2 influences the deflection of the electron beams, as will be explained below.

Figure 3:
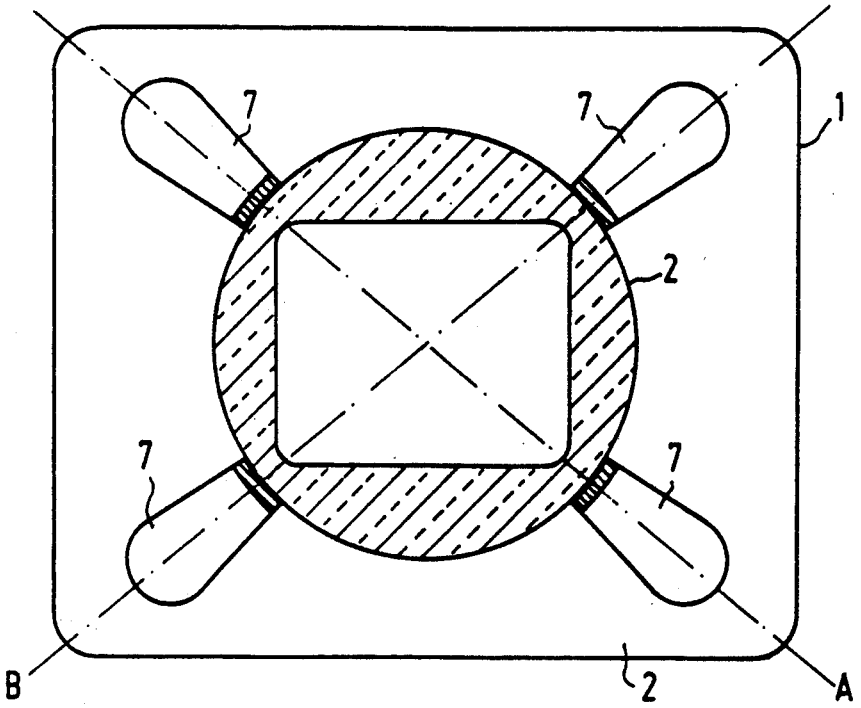
FIG. 3 is a diagrammatic rear view of the display tube shown in FIG. 1, sectioned on the line III—III, and provided with X-ray absorbing means on the diagonals of the envelope portion according to the invention.
Figure 2A:
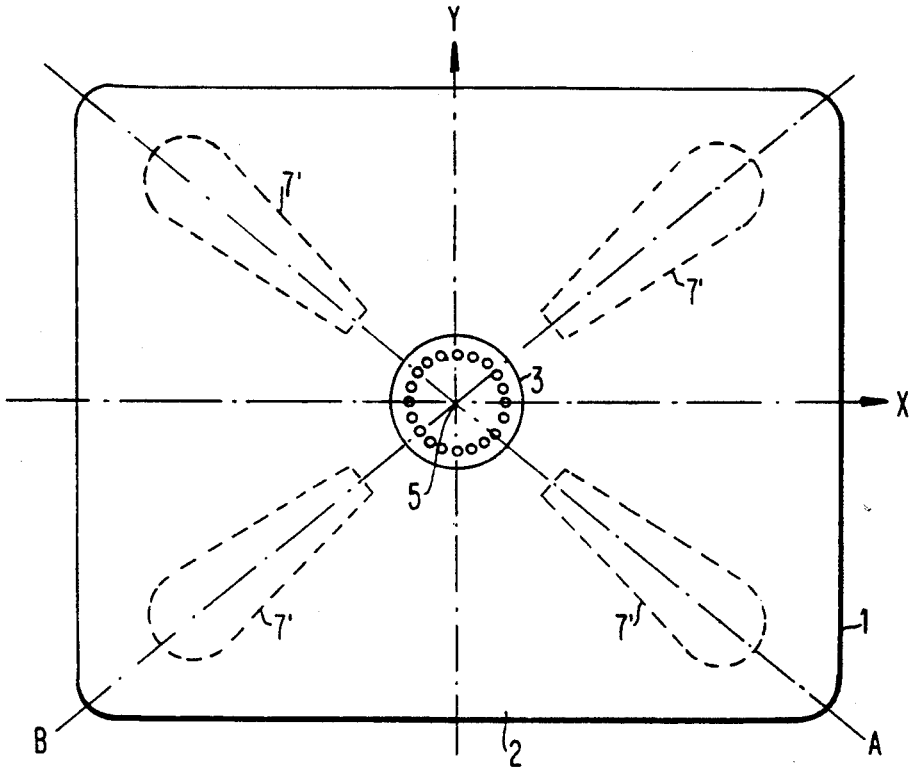
Figure 4:
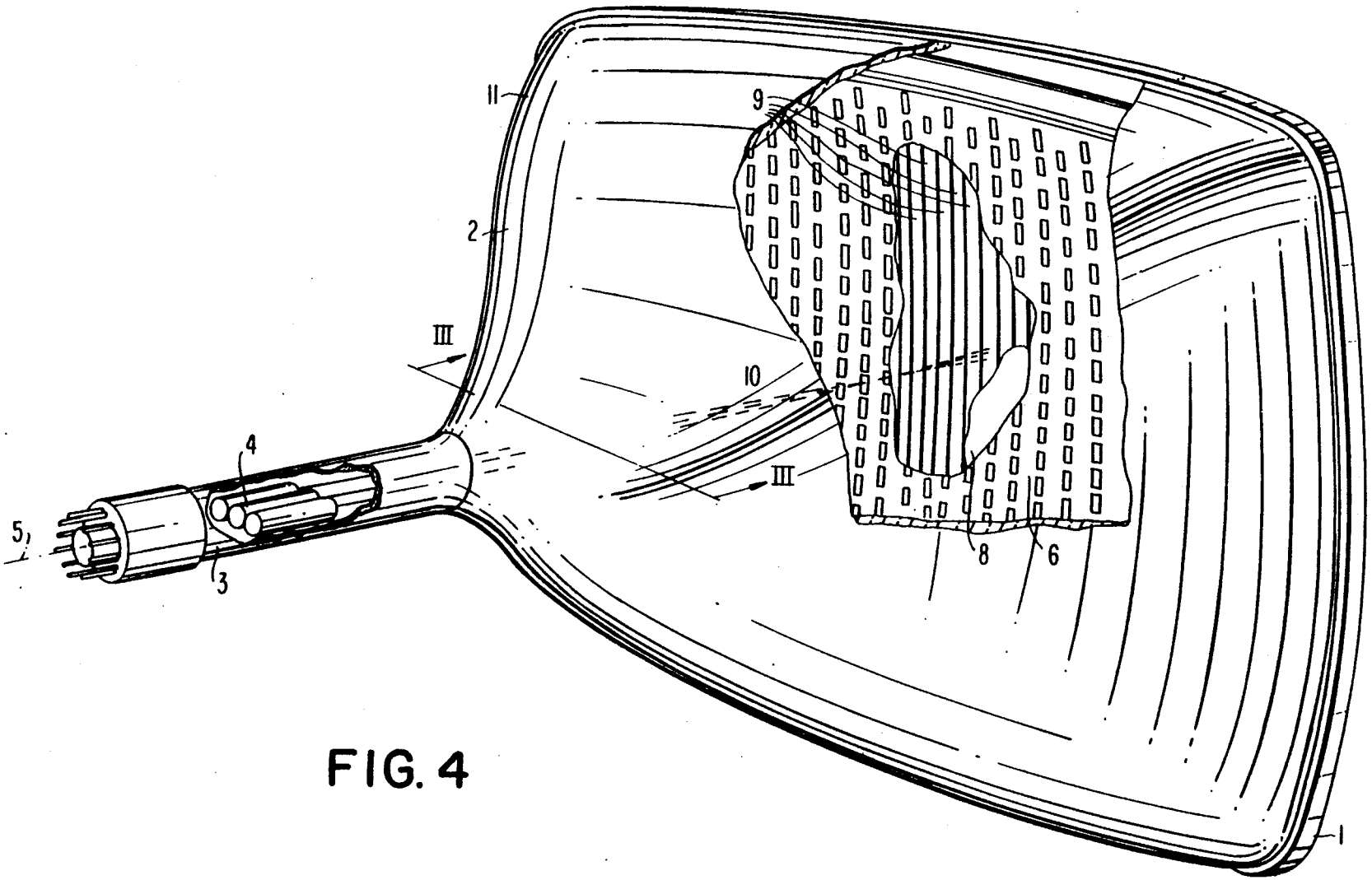
FIG. 4 is an elevational view of a display tube, such as seen in FIG. 1, with a further feature according to the present invention.

During operation of the display tube, electron beams are deflected across the screen by the deflection coils. When the display screen is rectangular, the angle of deflection of the electron beams to the corners of the display screen is largest. To preclude that these electron beams are incident on the inner wall of the envelope portion 2 and are reflected in an undesirable manner, the envelope portion 2 is constructed such that it is thinner at the location of the diagonals. This is realised, for example, by constructing the tools used in the manufacture of the envelope portion in such a manner that the wall thickness of the envelope portion is less at the diagonals than elsewhere. Measurements have shown that in this type of display tube more X-rays are released at the location of the diagonals of the envelope portion than in other parts of the envelope portion. It has been found that in this case it is not necessary to measure each display tube separately. Measuring the quantity of X-rays released from a test tube which is representative of this type of display tube is sufficient. The shape of the envelope portion 2 in this region is diagrammatically shown in FIG. 3, which is a sectional view of a display tube as shown in FIG. 1, taken on the line III—III. In this type of display tube, the discrete X-ray absorbing means 7 can be provided on the outside of the envelope portion 2, on the diagonals, to obtain a sufficient absorption of the quantity of X-rays released. The envelope portion 2 need only be provided with discrete X-ray absorbing means on the diagonals, when the glass wall of the envelope portion sufficiently absorbs the X-rays everywhere else. However, when more X-ray absorption is required in other parts of the envelope portion, this can be realised, for example, by providing further discrete means. Besides, it is alternatively possible to use a heavy metal-containing layer, which is uniformly provided over the entire envelope portion, such as seen in FIG. 4. This heavy metal-containing layer 11 substantially covers the entire envelope portion 2 in order to limit the quantity of x-rays released below the limiting value over a large part of the envelope portion. Localized parts 7 or 7', such as seen in FIGS. 2 and 2a, of the envelope portion where the x-ray release is still too high, are then covered with the discrete x-ray absorbing means.

Since the discrete means 7 absorb the X-rays released in places where the wall thickness of the envelope portion 2 is small (in this case the diagonals), the wall thickness to be used only has to be sufficient to withstand the vacuum pressure and need not be geared to the X-ray absorption. As a result, a substantial reduction in the quantity of glass necessary for the manufacture of the envelope portion can be attained. Moreover, a thinner wall of the envelope portion also permits reduction in the distance between the deflection coils and the tube axis 5, so that the electron beams can be deflected with less energy. In practice it has been found that the discrete X-ray absorbing means do not influence the deflection of the electron beams. To facilitate the location of other components on the outside of the envelope portion, the discrete X-ray absorbing means 7' are preferably arranged on the inside of the envelope portion, such as shown in phantom in FIG. 2a.

The discrete X-ray absorbing means are formed, for example, by a suspension containing Ba, Zr, Sr or Pb, which is provided on the envelope portion in the form of a layer, for example, by painting. Such means may alternatively be formed by a heavy metal which is provided in the glass of the envelope portion during the manufacture of the envelope portion. Preferably, the discrete X-ray absorbing means 7 consist of a tape containing a heavy metal, for example Pb, which tape can be provided on the envelope portion in a simple and accurate manner by, for example, adherence. Self-adhesive tapes provided with a layer containing a heavy metal are particularly easy to use. Such self-adhesive tapes containing heavy metal in various layer thicknesses are commercially available. The type of tape can be determined in accordance with the required X-ray absorption. Taking the current safety requirements into account, a required X-ray absorption can mostly be obtained by means of a self-adhesive tape having a 50 μm thick layer of Pb. Apart from a tape having a layer containing a heavy metal, for example, a heavy metal-impregnated tape can also be used. The shape of the tape depends on the shape of the portion of the envelope where X-ray absorption is required.

By way of example, the invention has been described in terms of a display tube having a conical, glass envelope portion. It will be obvious to those skilled in the art that the invention is not limited thereto and applies just as well to a display tube having a box-shaped envelope portion, and/or a metal envelope portion.

We claim:

1. A method of manufacturing a display tube comprising the steps of (a) forming a display tube having an envelope and a display window, (b) determining portions of said envelope where x-rays are released, and (c) providing discrete x-ray absorbing means at least at said portions where x-ray release exceeds a limiting value.

2. A method according to claim 1, wherein said step (c) is carried out by adhering a tape containing heavy metal to said portions.

3. A method according to claim 2, wherein said tape is formed with a self-adhesive.

4. A method according to claim 2, wherein said tape is formed with a layer containing heavy metal.

5. A method according to claim 2, wherein said tape is impregnated with heavy metal.

6. A display tube comprising (a) an envelope, (b) a display window connected to said envelope, and (c) discrete x-ray absorbing means for locally providing x-ray absorption of x-rays escaping from said envelope, such that any released x-rays remain below a limiting value.

7. A display tube according to claim 6, wherein said discrete x-ray absorbing means includes a tape disposed at least in part on said envelope, said tape containing a heavy metal.

8. A display tube according to claim 7, wherein said tape includes a self-adhesive at one side.

9. A display tube according to claim 7, wherein said tape includes a layer of said heavy metal.

10. A display tube according to claim 7, wherein said tape is impregnated with said heavy metal.

11. A display tube according to claim 7, wherein said heavy metal is at least one of Ba, Zr, Sr and Pb.

12. A display tube according to claim 6, wherein said display window is substantially rectangular and includes a substantially rectangular, luminescing display screen, said display screen being disposed at an interior surface of said display window, wherein said envelope includes a cylindrical neck portion having an electron-generating system, and wherein said discrete x-ray absorbing means are disposed locally on at least diagonals of said envelope.

13. A display tube according to claim 12, wherein said discrete x-ray absorbing means includes a tape disposed at least in part on said diagonals of said envelope, said tape containing a heavy metal.

14. A display tube according to claim 13, wherein said tape includes a self-adhesive at one side.

15. A display tube according to claim 13, wherein said tape includes a layer of said heavy metal.

16. A display tube according to claim 13, wherein said tape is impregnated with said heavy metal.

17. A display tube according to claim 13, wherein said heavy metal is at least one of Ba, Zr, Sr and Pb.

18. A display tube according to claim 6, wherein said discrete x-ray absorbing means are disposed on one of inside portions and outside portions of said envelope.

19. A display device according to claim 6, wherein a layer of heavy metal is disposed substantially completely on said envelope, said layer of heavy metal being in addition to said discrete x-ray absorbing means.

* * * * *